US011794223B2

(12) United States Patent
Harteel

(10) Patent No.: US 11,794,223 B2
(45) Date of Patent: Oct. 24, 2023

(54) METHOD FOR THE PREVENTION OF BIOFILM AND SEDIMENTATION IN SPRINGS

(71) Applicant: Harteel, Besloten Vennootschap Met Beperkte Aansprakelijkheid, Sint-niklaas (BE)

(72) Inventor: Gustaaf Harteel, Sint-niklaas (BE)

(73) Assignee: Harteel, Besloten Vennootschap Met Beperkte Aansprakelijkheid, Sint-niklaas (BE)

( * ) Notice: Subject to any disclaimer, the term of this patent is extended or adjusted under 35 U.S.C. 154(b) by 0 days.

(21) Appl. No.: 17/631,951

(22) PCT Filed: Jul. 29, 2020

(86) PCT No.: PCT/IB2020/057135
§ 371 (c)(1),
(2) Date: Feb. 1, 2022

(87) PCT Pub. No.: WO2021/024098
PCT Pub. Date: Feb. 11, 2021

(65) Prior Publication Data

US 2022/0288654 A1 Sep. 15, 2022

(30) Foreign Application Priority Data

Aug. 2, 2019 (BE) ..... 2019/5504

(51) Int. Cl.
*B08B 9/027* (2006.01)
*B08B 7/02* (2006.01)
*E21B 37/00* (2006.01)

(52) U.S. Cl.
CPC ..... *B08B 9/027* (2013.01); *B08B 7/028* (2013.01); *E21B 37/00* (2013.01)

(58) Field of Classification Search
CPC ..... B08B 9/027; B08B 7/028; E21B 37/00
See application file for complete search history.

(56) References Cited

U.S. PATENT DOCUMENTS 5,595,243 A * 1/1997 Maki, Jr. ..... E21B 43/003 166/177.2
5,676,213 A * 10/1997 Auzerais ..... E21B 37/00 166/177.2

(Continued)

FOREIGN PATENT DOCUMENTS

DE 102014206820 A1 10/2015
EP 1994994 A1 11/2008

(Continued)

OTHER PUBLICATIONS

International Search Report & Written Opinion to corresponding PCT Application No. PCT/IB2020/057135 dated Oct. 28, 2020.

*Primary Examiner* — Sharidan Carrillo
(74) *Attorney, Agent, or Firm* — Dinsmore & Shohl LLP

(57) ABSTRACT

Method for the prevention and/or removal of biofilm and sediment formation in borehole tubes or distribution tubes, with the following steps: (i) mounting one or more ultrasonic transducers (9, 9') on an aboveground part of the tube; (ii) sending the ultrasonic waves whereby both the power and the frequency of the ultrasonic waves are varied in time, with a frequency between 20 and 60 kHz and a power between 1 and 6 Watt for smaller tubes and between 6 and 40 Watt for larger tubes; (iii) sending the varying ultrasonic waves through the water that flows or is pumped through the tube; (iv) providing an automatic interruption of the effect of the ultrasonic waves when the flow of the water through the tube stops, either by shutting off the transducers, or by the automatic operation of a non-return valve which interrupts the water column between the transducer and the underlying mass of water.

9 Claims, 3 Drawing Sheets

(56) References Cited

U.S. PATENT DOCUMENTS

| | | | | |
|---|---|---|---|---|
| 6,418,960 | B1 | 7/2002 | Mintz et al. | |
| 2002/0070017 | A1* | 6/2002 | Soliman | E21B 28/00 166/249 |
| 2005/0269078 | A1* | 12/2005 | Morgenthaler | B08B 3/12 166/177.6 |
| 2008/0149331 | A1* | 6/2008 | Fitzgerald | E21B 43/10 166/255.1 |
| 2018/0163517 | A1* | 6/2018 | Xiao | E21B 41/02 |
| 2019/0352775 | A1* | 11/2019 | Peng | B08B 7/028 |

FOREIGN PATENT DOCUMENTS

| | | | |
|---|---|---|---|
| JP | S5464755 | A | 5/1979 |
| WO | 0131328 | A1 | 5/2001 |
| WO | 2013169984 | A1 | 11/2013 |

* cited by examiner

METHOD FOR THE PREVENTION OF BIOFILM AND SEDIMENTATION IN SPRINGS

CROSS-REFERENCE TO RELATED APPLICATIONS

The present application is the National Phase entry of International Patent Application No. PCT/IB2020/057135 filed Jul. 29, 2020, which claims priority to Belgium Patent Application No. 2019/5504 filed Aug. 2, 2019, the entire contents of both are hereby incorporated by reference into this application.

TECHNICAL FIELD

The present disclosure relates to a method for preventing and combating biofilm and sedimentation in water springs.

BACKGROUND

In particular, the present disclosure is intended for the population of boreholes for water springs, in which a pump is inserted into the ground water which pumps up water through a riser tube up to the surface.

This population can be divided into small pits, with a riser tube diameter of <5 cm usually made from synthetic material, and large pits, with a riser tube diameter of >5 cm and usually made from steel.

It is known that a biofilm forms on the inside of the riser tube or distribution tube under the influence of bacteria that are in the water and feed on the salts that are dissolved in the water. The bacteria nestle in a protective layer or biofilm containing amongst other things secreted polyglucans and also in micro-cracks that protect the bacteria even better, even against chemical control agents such as chlorine dioxide.

This allows sulphur-reducing bacteria (or SRB bacteria) to convert sulphur into sulphuric acid ($H_2SO_4$) and hydrogen sulphide ($H_2S$) resulting in the formation of sediments that are corrosive for metal tubes leading to corrosion of the tubes.

All this results in the clogging of the tubes on the inside with an increasingly thicker layer of biofilm, such that the flow of the water spring or borehole gradually decreases, until it becomes completely blocked and water can no longer pass through.

SUMMARY

The purpose of the present disclosure is to provide a solution to the aforementioned and other disadvantages, by providing a method which allows the formation of biofilm and sediment in borehole tubes or distribution tubes to be prevented or removed if any biofilm already formed.

To this end, the present disclosure relates to a method for preventing and/or removing biofilm and sediment formation in borehole tubes or distribution tubes, which comprises at least the following steps:

(i) mounting one or more ultrasonic sound sources in the form of one or more ultrasonic transducers on an aboveground part of the borehole tube or the distribution tube;

(ii) sending the ultrasonic waves of the one or more ultrasonic transducers by a control box whereby both the power and the frequency of the ultrasonic waves are varied in time, and whereby the frequency is controlled between 20 and 60 kHz and the power is controlled between 1 and 6 Watt for smaller tubes with a diameter <5 cm and between 6 and 40 Watt for larger tubes with a diameter >5 cm;

(iii) sending the varying ultrasonic waves through the water that flows or is pumped through the borehole tube or distribution tube;

(iv) providing the possibility to automatically interrupt the effect of the ultrasonic waves when the flow of the water through the tube stops, as a result of stopping or switching off the pump that makes the waterflow through the tube or another cause, whereby the effect of the ultrasonic waves is lifted, either due to one or more transducers shutting off automatically with or without a set waiting period, or due to the immediate automatic operation of a non-return valve in the tube, said valve interrupting the water column between the ultrasonic transducer(s) and the underlying mass of water in the water spring or the distribution network as soon as the pump no longer pumps or there is no more waterflow from the water spring.

An aspect of this method is that the water spring or the distribution network is safeguarded from the formation of biofilm and sediment as long as the waterflows in the tubes and on the other hand, when interrupting the flow of the water but not the ultrasonic waves in the water, the method prevents too much biofilm and sediment coming loose from the walls of the tube and accumulating at the bottom of the water spring or the distribution network, resulting in a blockage of the tubes.

As such it is not necessary to interrupt the ultrasonic waves for a short interruption of the waterflow, but it is necessary if the interruption extends over a longer period of time.

As such, in the event of an automatic shut off of one or more transducers, to build in a set but limited waiting period, e.g. seven days, during which the ultrasonic waves will continue to be effective in the stationary water of the borehole tube or distribution tube.

In the event of an automatic shut off due to the automatic operation of a non-return valve in the tube, the source of the ultrasonic waves itself is not shut off, but its effect on the water in the borehole tube or distribution tube is, due to the interruption of the water column through which the ultrasonic waves have to move, such that the ultrasonic waves can no longer propagate in to the water table or the stationary water in the distribution tubes.

The ultrasonic waves can propagate over long distances through a closed water column, particularly in tubes with a large diameter, even up to 4 to 5 km far. In tubes with a smaller diameter such as for example synthetic tubes for the water supply of chicken houses this is not the case. The presence of regulators or constrictions to control the waterflow that ends up with the animals prevents an unhindered propagation of the ultrasonic waves such that their reach may be limited to a few tens of metres.

In some embodiments, over a time span of 10 seconds the control box sends at least five to eight different frequencies through the transducers with the intention of being able to generate several specific resonances with the bacteria and biofilm to be combated, such that they are killed or broken up and the fragments are carried along with the waterflow.

The one or more ultrasonic transducers on an aboveground part of the borehole tube or the distribution tube may be mounted against the steel of the tube itself and cannot make direct contact with the mass of water in the tube. In this case the ultrasonic waves are chiefly passed on through the metal in the tube to other parts of the tube and other parts of the mass of water in the tube.

Alternatively, the one or more ultrasonic transducers may be mounted on an aboveground part of the borehole tube or the distribution tube and, through an opening in the tube itself, make direct contact with the mass of water in the tube. In this case, the sound waves themselves continuously propagate through the mass of water.

In some embodiments, the non-return valve in the tube, said valve interrupting the water column, is mounted between the ultrasonic transducer(s) and the underlying mass of water just upstream from the ultrasonic transducer.

When stopping the waterflow through the tube, the non-return valve will interrupt the water column between the mass of water in the water spring or the distribution network and the ultrasonic sound source, such that the ultrasonic waves no longer reach the underlying mass of water in the water spring or the distribution network.

This prevents further breakdown of biofilm or sediment with the formation of debris that can accumulate and cause a blockage as soon as the water spring is reactivated.

BRIEF DESCRIPTION OF THE DRAWINGS

With the intention of better showing the characteristics of the present disclosure, a few applications of the method for preventing biofilm and sedimentation in water springs according to the present disclosure are described hereinafter by way of an example, without any limiting nature, with reference to the accompanying drawings, wherein.

DETAILED DESCRIPTION

Figure 1:
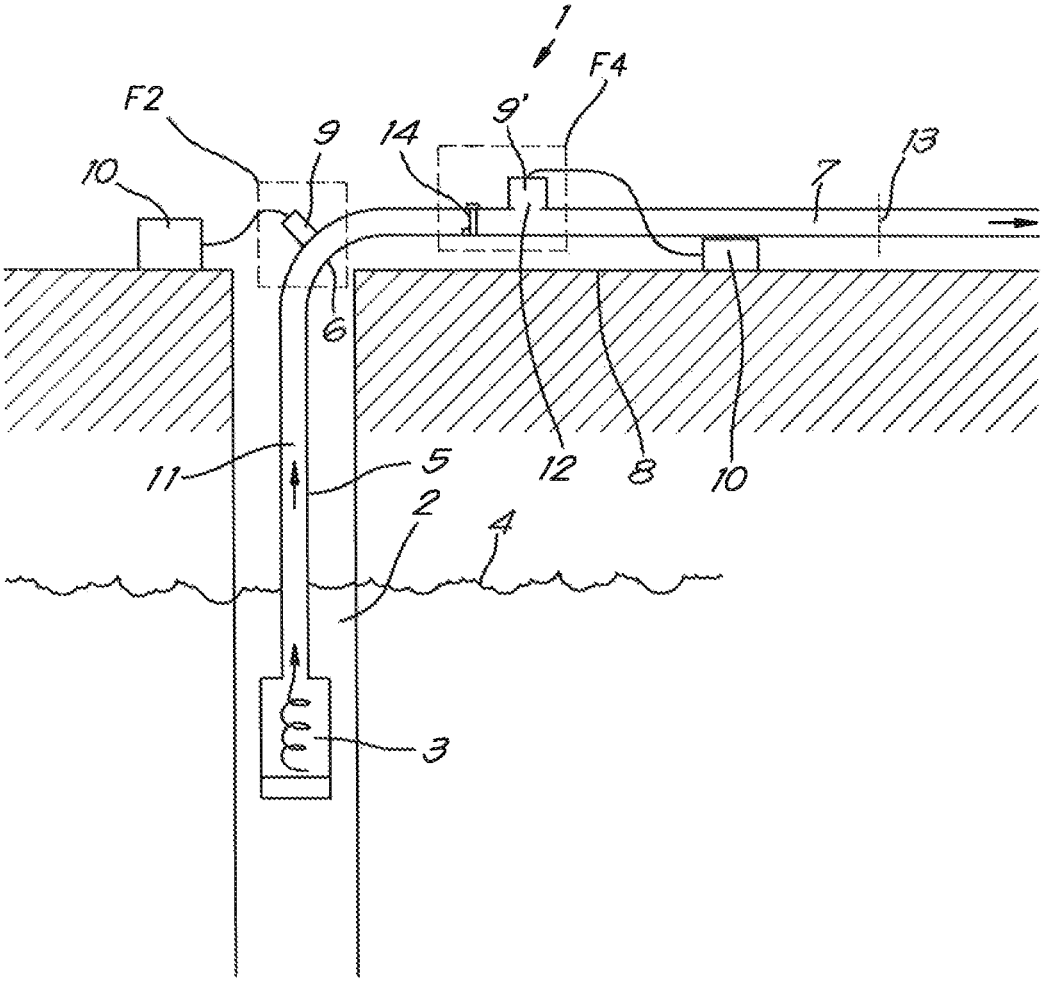
FIG. 1 schematically and in cross-section shows a water spring equipped with an ultrasonic sound source according to the present disclosure.

FIG. 1 schematically shows a water spring 1, from which water 2 is pumped up by a pump 3, which is located under the water table 4, and pumps the water 2 up through a vertical riser tube 5 which, once aboveground, shows an elbow 6 and continues as a horizontal tube 7 over the ground 8. An ultrasonic sound source such as an ultrasonic transducer 9 can be mounted in several locations aboveground.

In a first variant the ultrasonic transducer 9 is mounted on the elbow 6, and the transducer 9 is connected to a control box 10 for sending the ultrasonic waves, whereby the transducer 9 makes contact with the metal of the riser tube 5 and not directly with the water column 11 in the tube.

In a second variant the ultrasonic transducer 9' is mounted on the horizontal tube 7 on the surface and is also connected to a control box 10' for sending the ultrasonic waves, but in this case the transducer 9' is in direct contact with the water in the horizontal tube 7 through an opening 12 in the tube against which the transducer 9' is positioned.

In some embodiments, a sediment filter 13 is provided with which the amount of sediment carried along in the pumped up water can be filtered and measured. When the measured amount of sediment falls under a certain limit value over a given time span, said measured amount can be used to shut off the ultrasonic transducer 9. A non-return valve 14 can be provided upstream from the transducer 9'.

Figure 2:
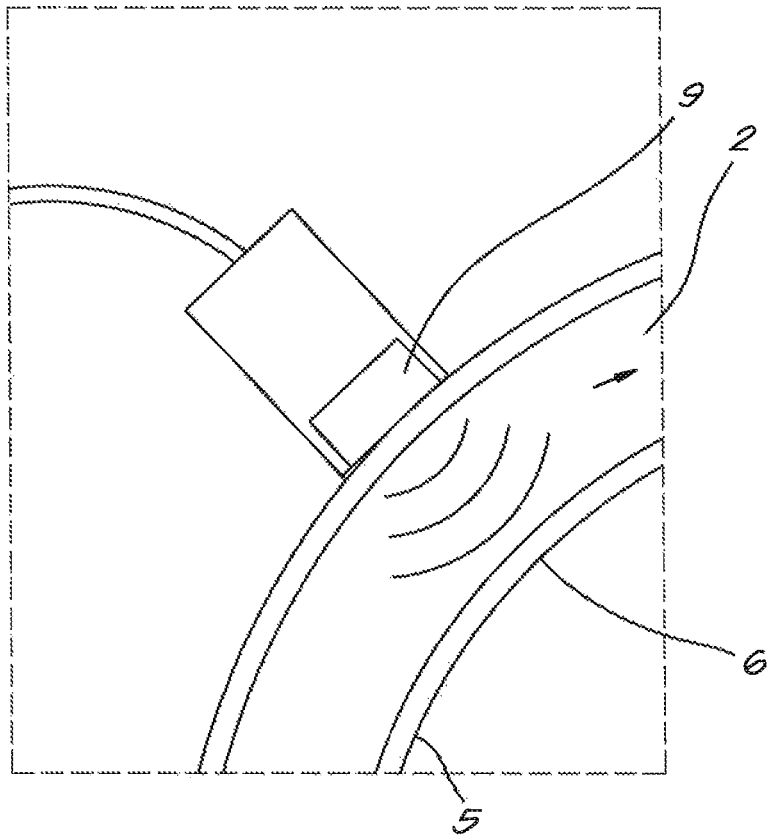
FIG. 2 shows a part of FIG. 1 indicated with F2 on a larger scale.

FIG. 2 shows a detail of FIG. 1 on a larger scale, illustrating that the ultrasonic transducer 9 which is mounted on the elbow 6 of the riser tube 5, is in direct contact with the metal wall of the elbow 6, and does not make direct contact with the water 2 that flows through the riser tube 5 to the surface. In this case the ultrasonic waves propagate via the metal of the riser tube 5.

Figure 3:
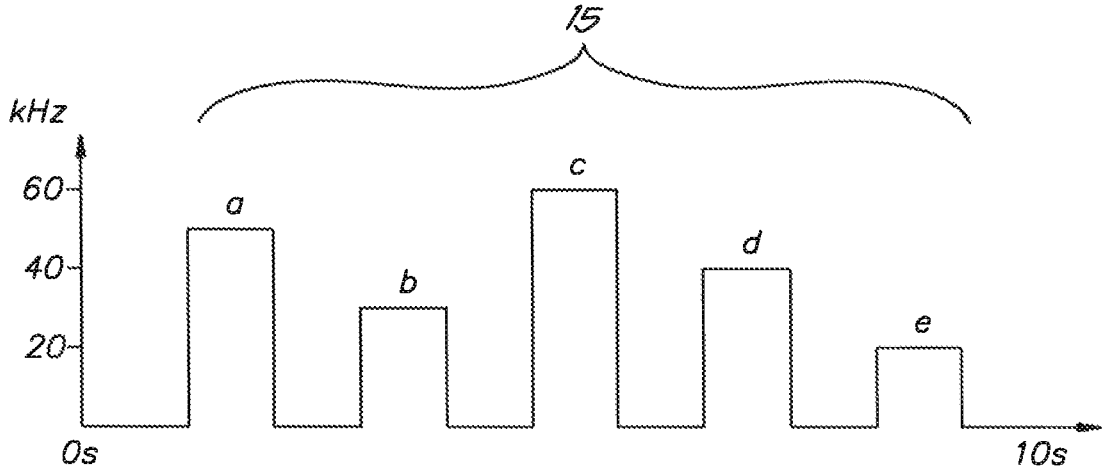
FIG. 3 schematically shows a series of different frequencies sent by an ultrasonic sound source over a time span of 10 seconds through the transducer.

FIG. 3 schematically shows an example of a series 15 of, in this case, five different frequencies 15*a*-15*e* between 20 kHz and 60 kHz, which an ultrasonic sound source sends over a time span of 10 seconds through the transducer, controlled by a control box 10.

Figure 4:
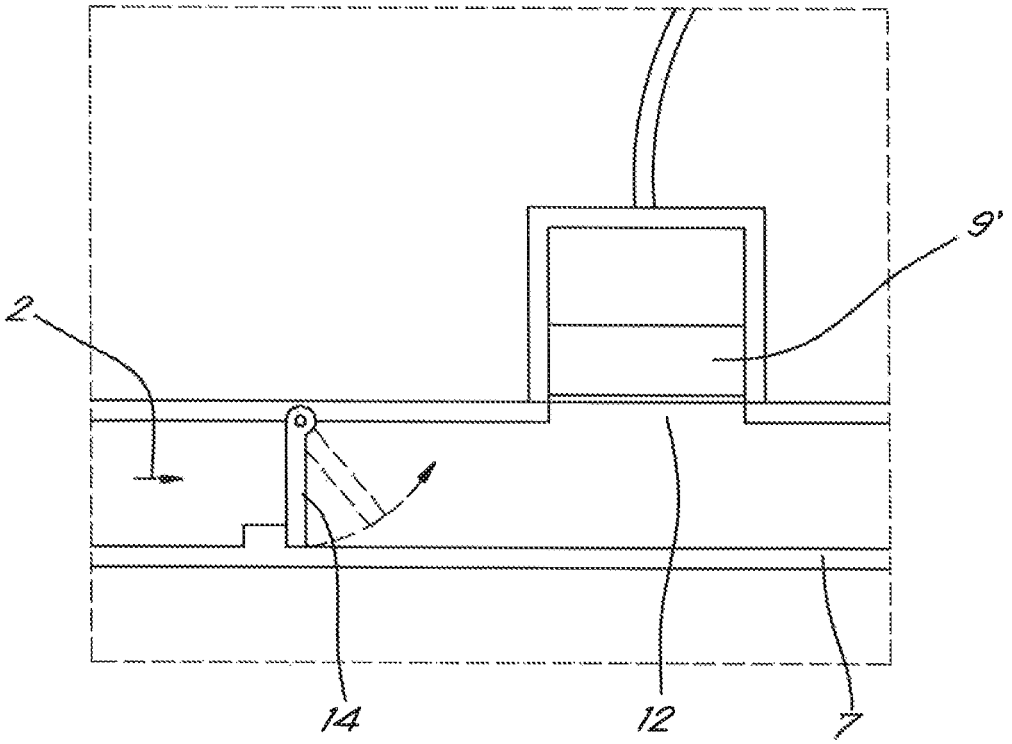
FIG. 4 in cross-section shows a non-return valve according to the present disclosure upstream from the ultrasonic transducer.

FIG. 4 shows the non-return valve 14 indicated with F4 on FIG. 1 on a larger scale. The non-return valve 14 opens under the influence of the pumped up flow of water 2, but closes when no more water is pumped up or pushed up by the water spring with which the horizontal tube 7 is connected, such that the water column in the riser tube 5 is interrupted and the ultrasonic waves no longer penetrate into the water spring.

The operation of the ultrasonic installation 1 is very simple and as follows.

The one or more ultrasonic transducers 9, 9' on an aboveground part 6.7 of the riser tube 5 send ultrasonic waves, of which both the power and the frequency of the ultrasonic waves are varied in time, and whereby the frequency is controlled between 20 and 60 kHz and the power is controlled between 1 and 6 Watt for smaller tubes with a diameter <5 cm, and between 6 and 40 Watt for larger tubes with a diameter >5 cm by a control box 10, 10' which is connected to the one or more transducers 9, 9'.

The effect of the ultrasonic waves, namely preventing and combating biofilm and sediment in the tubes, is automatically interrupted when the flow of the water through the tube stops, because the pump which makes the waterflow through the tube stops or is shut off or because of another cause. This occurs either due to the automatic shut off the one or more transducers 9, 9', with or without a set waiting period of for example a week, or immediately due to the automatic operation of a non-return valve 14 in the tube 7, said valve interrupting the water column between the ultrasonic transducer 9' and the underlying mass of water 2 in the water spring as soon as the pump no longer pumps or the water spring no longer produces any flow.

As long as the ultrasonic waves are sent through the water in the tubes, the formation of biofilm and ultimately sediment is prevented or combated and the water spring remains operational. When the water in the water spring is stationary, it may be better to interrupt the ultrasonic waves, because after some time they can loosen already formed biofilm or sediment, such that the loosened biofilm sinks down as debris and causes blockage of the tubes or the water spring itself.

The protective effect of the ultrasonic waves can extend over long distances, even kilometres in tubes with a large diameter. This does not apply to tubes with a small diameter in which the presence of regulators or constrictions to control the waterflow often prevents an unhindered propagation of the ultrasonic waves.

Instead of mounting one or more ultrasonic sound sources in the form of one or more ultrasonic transducers 9 or 9' on an aboveground part of the borehole tube 6 or the distribution tube 7, alternatively they can be provided in the water, i.e. in the borehole under the water table, that is if there is sufficient space available to this end between the wall of the borehole and the pumping tube.

This variant method requires the application of the other steps of the method according to the present disclosure.

The present disclosure is not limited to the embodiments described as an example and shown in the drawings, but such a method for preventing biofilm and sedimentation in water springs can be realised according to different variants without departing from the scope of the present disclosure, as is defined in the following claims.

The invention claimed is:

1. A method for prevention and/or removal of biofilm and for prevention of sediment formation in a borehole tube or a distribution tube of a water spring, the method comprises:

(i) mounting one or more ultrasonic transducers on an aboveground part of the borehole tube or the distribution tube;

(ii) sending ultrasonic waves of the one or more ultrasonic transducers whereby both a power and a frequency of the ultrasonic waves are varied in time, and whereby the frequency is controlled between 20 and 60 KHz and the power is controlled between 1 and 6 Watt for smaller tubes with a diameter <5 cm and between 6 and 40 Watt for larger tubes with a diameter >5 cm;

(iii) sending the varying ultrasonic waves through a water that flows or is pumped through the borehole tube or the distribution tube to prevent and/or remove the biofilm and to prevent the sediment formation in the borehole tube or the distribution tube; and (iv) automatically interrupting an effect of the ultrasonic waves when the flow of the water through the borehole tube or the distribution tube stops, whereby the effect of the ultrasonic waves is interrupted, either due to the one or more ultrasonic transducers shutting off automatically immediately or after an elapse of a waiting period of time from when the flow of the water through the borehole tube or distribution tube stops, or immediately due to automatic operation of a non-return valve in the borehole tube or the distribution tube, the valve interrupting a water column between the one or more ultrasonic transducers and an underlying mass of the water as soon as a pump no longer pumps or there is no more waterflow from the water spring from which the water is pumped by the pump, wherein the non-return valve interrupting the water column between the one or more ultrasonic transducers and the underlying mass of water, is mounted upstream from the one or more ultrasonic transducers.

2. The method according to claim 1, wherein over a time span of 10 seconds at least five to eight different frequencies are sent through the one or more ultrasonic transducers.

3. The method according to claim 1, wherein the one or more ultrasonic transducers are mounted on the aboveground part of the borehole tube or the distribution tube against a steel of the borehole tube or the distribution tube itself, and do not make direct contact with the underlying mass of the water in the borehole tube or the distribution tube.

4. The method according to claim 1, wherein the one or more ultrasonic transducers are mounted on the aboveground part of the borehole tube or the distribution tube and via an opening in the borehole tube or the distribution tube itself, make direct contact with the mass of water in the borehole tube or the distribution tube.

5. The method according to claim 1, wherein a sediment filter is provided with which an amount of sediment in the water pumped by the pump can be filtered and measured, such that when the measured amount of sediment over a certain time span falls under a certain limit value, the one or more ultrasonic transducers is shut off.

6. A method for prevention and/or removal of biofilm and for prevention of sediment formation in a borehole tube or a distribution tube of a water spring, the method comprises:

(i) mounting one or more ultrasonic transducers on an aboveground part of the borehole tube or the distribution tube;

(ii) sending ultrasonic waves of the one or more ultrasonic transducers whereby both a power and a frequency of the ultrasonic waves are varied in time, and whereby the frequency is controlled between 20 and 60 kHz and the power is controlled between 1 and 6 Watt for smaller tubes with a diameter <5 cm and between 6 and 40 Watt for larger tubes with a diameter >5 cm;

(iii) sending the varying ultrasonic waves through a water that flows or is pumped through the borehole tube or the distribution tube to prevent and/or remove the biofilm and to prevent the sediment formation in the borehole tube or the distribution tube; and (iv) automatically interrupting an effect of the ultrasonic waves when the flow of the water through the borehole tube or the distribution tube stops, whereby the effect of the ultrasonic waves is interrupted, either due to the one or more ultrasonic transducers shutting off automatically immediately or after an elapse of a waiting period of time from when the flow of the water through the borehole tube or distribution tube stops, or immediately due to automatic operation of a non-return valve in the borehole tube or the distribution tube, the valve interrupting a water column between the one or more ultrasonic transducers and an underlying mass of the water as soon as a pump no longer pumps or there is no more waterflow from the water spring from which the water is pumped by the pump, wherein a sediment filter is provided with which an amount of sediment in the water pumped by the pump can be filtered and measured, such that when the measured amount of sediment over a certain time span falls under a certain limit value, the one or more ultrasonic transducers is shut off.

7. The method according to claim 6, wherein over a time span of 10 seconds at least five to eight different frequencies are sent through the one or more ultrasonic transducers.

8. The method according to claim 6, wherein the one or more ultrasonic transducers are mounted on the aboveground part of the borehole tube or the distribution tube against a steel of the borehole tube or the distribution tube itself, and do not make direct contact with the underlying mass of the water in the borehole tube or the distribution tube.

9. The method according to claim 6, wherein the one or more ultrasonic transducers are mounted on the aboveground part of the borehole tube or the distribution tube and via an opening in the borehole tube or the distribution tube itself, make direct contact with the underlying mass of the water in the borehole tube or the distribution tube.

* * * * *